United States Patent [19]

Towns et al.

[11] Patent Number: 4,793,504

[45] Date of Patent: Dec. 27, 1988

[54] CLOSURE WITH CONTAINMENT OF TELLTALE MEANS

[75] Inventors: Edward J. Towns, Morristown; Edward M. Brown, Livingston, both of N.J.

[73] Assignee: TBL Development Corporation, Livingston, N.J.

[21] Appl. No.: 531,007

[22] Filed: Sep. 12, 1983

[51] Int. Cl.[4] ..... B65D 53/04

[52] U.S. Cl. ..... 215/250; 206/807; 215/350; 220/214; 220/258; 220/278; 220/377

[58] Field of Search ..... 215/203, 209, 211, 213, 215/214, 218, 219, 220, 230, 232, 247, 250, 252, 257, 258, 329, 341, 343, 344, 347, 349, 350, 351, 348, 365, 366; 116/200, 212, 306, 307; 73/762; 49/13; 220/214, 258, 304, 359

[56] References Cited

U.S. PATENT DOCUMENTS

| | | | |
|---|---|---|---|
| 603,151 | 4/1898 | Norton . | |
| 810,334 | 1/1906 | Green . | |
| 939,602 | 11/1909 | Landon . | |
| 1,095,313 | 5/1914 | Davids . | |
| 1,916,977 | 7/1933 | Gutmann | 215/329 X |
| 2,068,389 | 1/1937 | Smith | 215/350 |
| 2,090,555 | 8/1937 | Sharp . | |
| 2,131,774 | 10/1938 | Waring | 215/250 |
| 2,131,775 | 10/1938 | Waring | 215/250 |
| 3,489,307 | 1/1970 | Wenger | 215/351 X |
| 3,501,042 | 3/1970 | Risch et al. | 215/232 |
| 3,595,419 | 7/1971 | Dukess | 215/350 X |
| 3,612,325 | 10/1971 | Williams | 215/350 X |
| 3,826,221 | 7/1974 | Ross . | |
| 3,896,959 | 7/1975 | Roy | 215/350 X |
| 3,899,295 | 8/1975 | Halpern . | |
| 3,917,100 | 11/1975 | Dukess | 215/329 |
| 3,923,198 | 12/1975 | Brochman . | |
| 4,069,935 | 1/1978 | Hampel | 215/203 |
| 4,381,840 | 5/1983 | Ostrowsky | 215/329 |

*Primary Examiner*—Stephen Marcus
*Assistant Examiner*—Bryon Gehman
*Attorney, Agent, or Firm*—Robin, Blecker & Daley

[57] ABSTRACT

A container closure providing tamper indication includes tines therein in engagement with a tamper-indicating assembly which is nested in the closure and retained therein by the tines up to the point of telltale activation on container opening. The closure includes a member adapted to engage the tamper-indicating assembly subsequent to telltale activation both to remove the assembly from secured relation to a container and to retain the assembly with the closure in the course of its removal from the container and reapplication thereto.

12 Claims, 2 Drawing Sheets

CLOSURE WITH CONTAINMENT OF TELLTALE MEANS

FIELD OF THE INVENTION

This invention relates generally to containers of tamper-indicating type and pertains more particularly to closures having enhanced telltale containment capability.

BACKGROUND OF THE INVENTION

Several copending patent applications, commonly-assigned herewith, are descriptive of tamper-indicative systems for bottled and like goods, namely, application Ser. No. 441,109 filed on Nov. 12, 1982, Ser. No. 443,608 filed on Nov. 22, 1982 and Ser. No. 450,531 filed on Dec. 17, 1982. Common to such systems is the use of a see-through cap which has tines movable with the cap and in secured engagement with a telltale nested in the cap. In the '109 application, when the is threaded upon a container, the single-layer telltale thereof is secured by adhesive to the container mouth. With the telltale accordingly secured to both the cap and jar, it is ruptured by the tines as the cap is removed from the container providing visible indication of initial container opening, or of prior tampering.

In the system of the '608 application, the tine are blunted upon the undersurface of a single-layer telltale after passage therethrough and a single-layer container, sealing layer is secured to the periphery of the telltale under the blunted tines and is secured also to the jar container mouth upon application of the cap to the container. In this arrangement, the telltale is ruptured in situ above the sealing layer as the cap removed. telltale fragments, if any, are thus precluded from entering the container by the in-place sealing layer and may be removed from the liner before it is peeled away to permit access to the container contents.

In the '531 system, the telltale is a laminate with an opaque compressible layer in engaged relation to the cap tines and a glassine sealing layer having a telltale indicator on its surface facing the compressible layer and sealable to the container mouth at its opposite surface. In this case, the telltale indicator is rendered visible as the tines tear through the compressible layer as the cap is opened. Fragments of the compressible layer may be removed and the glassine layer then stripped from the container to gain access to its contents.

While the above described systems provide effective tamper indication, they do not accommodate what shall be termed "the alternative user preference", which requires both (1) that the telltale and sealing layer be removable with and be fully contained, including telltale fragments, by the cap upon its removal from the container and (2) that there be an adhesive or bonded seal between the cap liner and container access port up to the point of initial opening.

The retention of cap liners with the cap during cap shipment and cap application to containers is a present industry practice, as is shown, for example, in Dukess U.S. Pat. Nos. 3,819,460 and 3,917,100. A circumferential groove is formed in the cap immediately beneath the cap top panel above the cap threads. In commercial practice, the liner is force into the cap and nests in the retention grove. In practice described in the referenced patents, the liner includes a compressible layer which is said to be displaced radially outwardly of the liner into sealing relation with the groove wall as the cap is threaded upon a container. In both the commercial and the Dukess patented practices, tamper indication is not involved and there is no anchoring of the liners to the container mouth, as by adhesive or other bond.

Some approach is seen to partially realizing the alternative user preference in Waring U.S Pat. Nos. 2,131,774 and 2,131,775. In the tamper-evident systems of these patents, a telltale is nested in a metal cap adjacent a centrally open top panel, through which telltale destruction is seen on initial opening or upon prior tampering, and the telltale is removable with the cap, being secured to an underlying liner or to the cap. Apart from the deficiency of this approach from a security point of view, e.g., its telltale tearing members are accessible to a tamperer through the cap opening, and the customized character of the cap, the Waring patents expressly disavow any form of adhesive or bonded securement of the cap to the container, requiring that no adhesive bond exist between the cap and container. Accordingly, requirement (2) of the alternative user preference is not met.

SUMMARY OF THE INVENTION

The present invention has as its primary object the provision of tamper indication systems of the described type first noted above but wherein the alternative user preference is accommodated in both of its requirements..

It is a more particular object of the invention to provide an improved telltale assembly adapted for containment in a cap upon removal thereof from a container.

A specific object of the invention is to provide an improved tamper-evident container.

In attaining the foregoing add other objects, the invention provides a cap having tines depending from a top panel thereof, a telltale assembly engaged by the tines for movement therewith into container closing disposition, and means within the cap for engaging the telltale assembly selectively subsequent to its activation on cap opening both to break the sealing bond between the telltale assembly and container and to retain the telltale assembly with the cap. The telltale assembly is secured to the container mouth, as by induction heating, and the telltale assembly is so structured as to maintain its integrity as it is forcibly separated from such securement by such cooperative means in the course of cap opening movement.

The foregoing and other objects and features of the invention will be further understood from the following detailed description thereof and from the drawings wherein like reference numerals identify like parts throughout.

DESCRIPTION OF THE PREFERRED EMBODIMENTS AND PRACTICE

Figure 1:
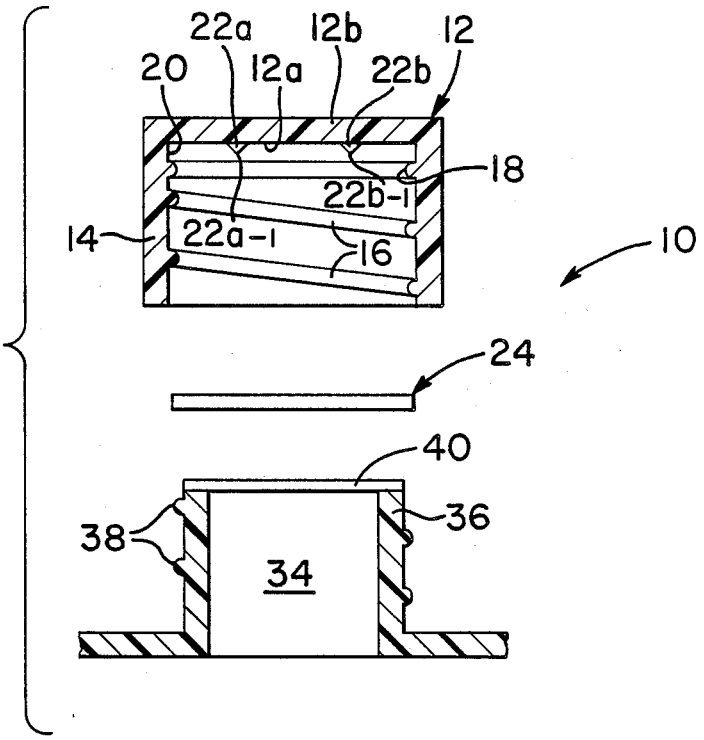
FIG. 1 is an exploded view of a container in accordance with the invention with the cap and jar neck sectioned as wound be seen from plane I—I of FIG. 5 and with the telltale shown without sectioning.

Referring to FIG. 1, container 10 includes cap or closure member 12 of see-through plastic material having skirt 14 with interior threads 16. A circumferential bead 18 projects inwardly from skirt 14 with threads 16, but is fully horizontally disposed, and defines with undersurface 12*a* of the cap top panel 12*b* a recess or groove 20. Tines 22*a*, 22*b* and 22*c* (FIG. 5) are movable with cap 12 in its rotative movement and are either formed integrally therewith or as an insert to the cap for such movement therewith. Each tine tapers to piercing apex as shown at 22*a*-1 and 22*b*-1 in FIG. 1 and is preferably of length below undersurface 18*a* less than the vertical run of recess 20.

Figure 4:
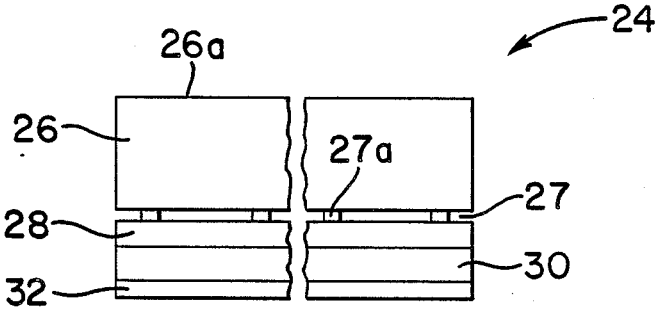
FIG. 4 is an enlarged showing of the telltale assembly of FIGS. 1–3.

The preferred structure of telltale assembly 24 is a laminate, as is seen in the enlarged view of FIG. 4. The laminate includes an uppermost compressible layer 26 of material, e.g., open cell styrofoam, which is rupturable and tearable by tines 22*a*–22*c*. This layer is desirably from thirty to thirty-five mils in thickness. A printed pattern is applied to top surface 26*a* of layer 26. A strip pattern adhesive 27 is applied to stiffening layer 28 for securement thereof to the undersurface of layer 26. This layer is comprised of a pressure-sensitive hot melt, available from Finley Adhesives, and may be about one mil in thickness. Assembly 24 is cylindrical or disk-shaped and the individual strips, one identified at 27*a*, of the pattern adhesive layer are spaced from other strips and extend chordally of the cylinder. Stiffening layer 28 is comprised of a clear K-resin, available from Phillips 66 and is preferably from four to ten mils. The above-mentioned pressure-sensitive adhesive bonds layer 28 to telltale layer 30, which is a paper of about one mil in thickness. Bottom layer 32 is a one mil aluminum foil which is coated with general purpose polyethylene or Surlyn etc. Color and pattern features are significant, both from a security and control viewpoint and tamper indication viewpoint. Thus, the printed pattern on surface 26*a* is desirably a thin line green imprinting to impart an anti-counterfeit character to telltale assembly 24. Layer 26 is preferably white foam and the coloration of telltale layer 30 is desirably red on its surface facing clear stiffening layer 28.

Returning to FIG. 1, jar 34 is partially shown and has neck 36 with exterior threads 38. A layer 40 of controlled release type adhesive may be applied to the mouth of neck 36. In assembly of cap 12 and telltale assembly 24, cap 12 is inverted from its FIG. 1 orientation and telltale assembly 24 is forced against surface 12*a* of top panel 12 by a rigid, e.g., metal, backing member applied to layer 32 of assembly 24. Layer 26 is punctured by the tines and the tines are deformed in the foam, effecting retention of assembly 24 by the tines. The results of this operation are seen in FIG. 2, wherein telltale assembly 24 is nested in recess 20 and is held by the tines in preselected spaced vertical relation to bead 18, for purposes below discussed.

Figure 2:
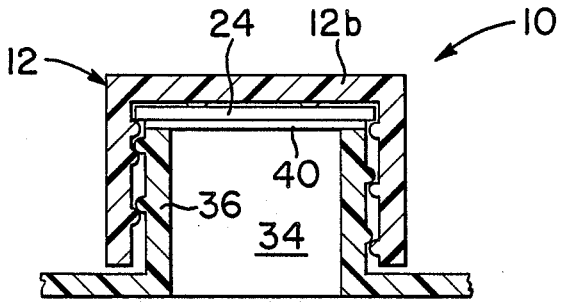
FIG. 2 is an assembled view of the FIG. 1 container parts with sectioning as in FIG. 1.
Figure 3:
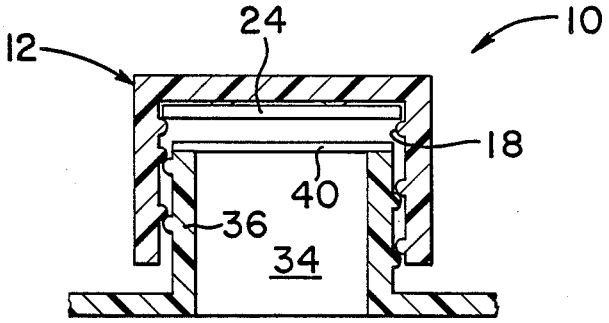
FIG. 3 is repeat showing of the FIG. 2 assembly with the cap partially unthreaded from the jar neck.
Figure 5:
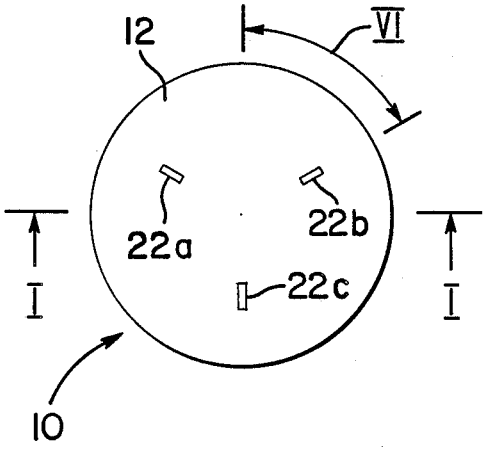
FIG. 5 is a top plan view of the container in its FIG. 2 disposition.

In the FIG. 2 showing, cap 12 is fully threaded in container closing sense (full clockwise movement as in FIG. 5). Layer 32 (FIG. 4) of telltale assembly 24 is secured to the mouth of neck 36 by adhesive layer 40 and the telltale assembly is thus anchored to both cap 12 and jar 34. Where layer 32 is polyethylene-coated aluminum, or other compatible coating as above discussed, the latter anchoring is done preferably by induction heating of the aluminum foil, which directly bonds the coating to the container neck, without need for a separate adhesive Based upon the above-noted vertical spacing of telltale assembly 24 above bead 18 in FIG. 2, a measure of counterclockwise (opening sense) rotation of cap 12 can occur prior to any confrontational engagement of bead 18 with layer 32 and hence prior to any discontinuance of the anchoring of assembly 24 to the mouth of neck 36. During such measure of rotation, indicated as angle VI in FIG. 5, tines 22*a*, 22*b* and 22*c* tear through foam layer 26, giving rise to a revealing of telltale layer 30 in areas 42, 44 and 46 as shown in FIG. 6, and the presentation of the vivid red layer 30 through the white foam against the green line background atop foam layer 26.

Figure 6:
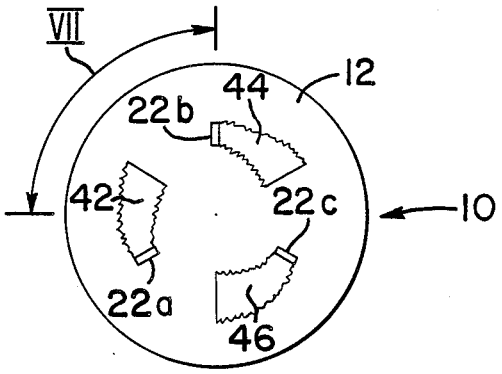
FIG. 6 is a repeat showing of FIG. 5 with the cap rotated in container opening sense through angle VI of FIG. 5.
Figure 7:
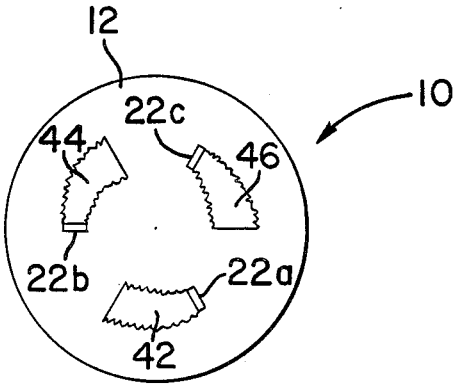
FIG. 7 is a top plan view of the container in its FIG. 3 disposition and rotated through further angle VII of FIG. 6.

In the course of further opening sense rotation of cap 12 from its FIG. 6 disposition, through angle VII, to its FIG. 7 disposition, bead 18 confrontingly engages the undersurface of layer 32 and applies upward camming force thereto. Thus, positive vertical upward displacement of bead 18, resulting from conversion of rotational cap movement to cap upward translation through engagement of threads 16 and 38, effects the discontinuance of the anchored relation as telltale assembly 24 and jar 34. In this activity, tearing of layer 26 by tines 22*a*–22*c* ceases, since the telltale assembly 24 is now free to rotate with cap 12 and tines 22*a*–22*c* no longer have movement relative to assembly 24.

Various features attend the structure and activity at hand. At the outset, it is to be seen that the above-referenced alternative user preference is realized in that the telltale assembly, though bonded to the container to the point of cap opening is retained with the cap after its activation on initial opening. Secondly, fragmentation or tearing of the foam layer 26 is spatially controlled, i.e., takes place only through angle VI of FIG. 5, or other angle as may be established by selection of the vertical spacing between telltale assemble layer 32 and rib 18. Thirdly, following from such controlled tearing of foam layer 26, reduced fragmentation is achieved and higher probability of fragment containment within cap 12 is realized in the presence of effective tamper indication. Fourthly, reseal capability is present, since layer 32 is unaffected in these activities.

A telltale assembly design consideration, which assists in the realization of the features discussed immediately above, is the character of layer 28 of telltale assembly 24. This layer is effective to withstand the camming force applied to the telltale assembly by bead 18 in the course of its release from jar 34, while at the same time retaining the cylindrical geometric configuration of assembly 24. In its functional configuration, assembly 24 will thus be seen to have an anti-counterfeit imprint atop a tine securement layer (layer 26), a layer for maintenance structural integrity (layer 28), a telltale (layer 30) and sealing and reseal layer (layer 32).

In different aspect, cap 12 will be seen to have plural and successively operative means for retention of telltale assembly 24. Tines 22*a*–22*c* represent first means for telltale assembly retention, being imbedded in layer 26 upon cap and telltale assembly. Bead 18 is inactive until such time as tines 22*a*–22*c* have ruptured layer 26 and lost retentive relation therewith, but follows telltale assembly 24 to retentively and continuingly engage the same following telltale activation.

Various changes in structure and modifications in practice from that discussed above may be introduced without departing from the invention By way of example, an alternative structure for telltale assembly 24 would be to form the telltale indication atop the stiffening layer, as by coloration on the upper surface thereof. The stiffening layer may now be constituted of opaque material, such as hardboard, since the telltale indication is not required to be seen therethrough as i the first discussed embodiment, wherein the stiffening layer of K-resin has see-through character. Accordingly, the particularly disclosed embodiment and practices are intended in an illustrative and not in a limiting sense. The true spirit and scope of the invention is set forth in the following claims.

We claim:

1. A container closure having a see-through closure member defining container closing expanse, a tamper-indicating element in said closure interiorly of said closure member, first means movable with said closure for both retaining said tamper-indicating element with said closure and for selectively tearing said tamper-indicating element and second means in said closure for engaging said tamper-indicating element selectively following such tearing thereof for retaining said tamper-indicating element with said closure, said tamper-indicating element comprising a rupturable and tearable layer, said first means being secured in said rupturable and tearable layer, a stiffening layer juxtaposed with said rupturable and tearable layer, and a telltale layer juxtaposed with said stiffening layer and exposed therethrough upon tearing of said rupturable and tearable layer by said first means, and a container sealing layer juxtaposed with said telltale layer, said second means being disposed in spaced confronting relation to said container sealing layer.

2. The closure claimed in claim 1 wherein said first means comprises at least one retaining-rupturing member extending from said closure member into engagement with said indicating element.

3. The closure claimed in claim 2 wherein said closure member includes a top panel and a threaded skirt depending therefrom, said retaining-rupturing member extending downwardly from said top panel, said second means being situated upwardly of such skirt threads and downwardly of said retaining-rupturing member.

4. The closure claimed in claim 1 wherein both said first means and said second means are integral with said closure member.

5. A tamper-indicating container comprising:

(a) a vessel for article containment and having an access opening;

(b) a see-through closure member for first sense movement relative to said vessel into securement therewith and in circumscribing relation to said access opening and for second opposite sense movement for release from such securement;

(c) first and second means disposed interiorly of said closure member for travel with said closure member; and (d) indicating means in captive relation to said first means for movement therewith during said closure member first sense movement into securement with said vessel across said access opening, said first means tearing said indicating means in the course of said closure member second sense movement to provide such tamper indication, said second means engaging said indicting means following such tearing thereof and releasing said indicating means from said securement thereof with said vessel, said tamper-indicating element comprising a rupturable and tearable layer, said first means being secured in said rupturable and tearable layer, a stiffening layer juxtaposed with said rupturable and tearable layer, and a telltale layer juxtaposed with said stiffening layer and exposed therethrough upon tearing of said rupturable and tearable layer by said first means, and a container sealing layer juxtaposed with said telltale layer, said second means being disposed in spaced confronting relation to said container sealing layer.

6. The closure claimed in claim 5 wherein said first means comprises at least one retaining-rupturing member extending from said closure member into engagement with said indicating means.

7. The closure claimed in claim 6 wherein said closure member includes a top panel and a threaded skirt depending therefrom, said retaining-rupturing member extending downwardly from said top panel, said second means being situated upwardly of such skirt threads and downwardly of said retaining-rupturing member.

8. The closure claimed in claim 5 wherein both said first means and said second means are integral with said closure member.

9. A tamper-indicating container comprising:

(a) a vessel for article containment and having an access opening;

(b) a see-through closure for first sense movement relative to said vessel into securement therewith and in circumscribing relation to said access opening and for second opposite sense movement for release from such securement;

(c) a tamper-indicating element in said closure;

(d) first means movable with said closure for both retaining said tamper-indicating element with said closure and for selectively tearing said tamper-indicating element; and (e) second means in said closure for engaging said tamper-indicating element selectively following such tearing thereof for retaining said tamper-indicating element with said closure, said tamper-indicating element comprising a rupturable and tearable layer, said first means being secured in said rupturable and tearable layer, a stiffening layer juxtaposed with said rupturable and tearable layer, and a telltale layer juxtaposed with said stiffening layer and exposed therethrough upon tearing of said rupturable and tearable layered by said first means, and a container sealing layer juxtaposed with said telltale layer, said second means being disposed in spaced confronting relation to said container sealing layer.

10. The container claimed in claim 9 wherein said first means comprises at least one retaining-rupturing member extending from said closure into engagement with said indicating element.

11. The closure claimed in claim 9 wherein both said first means and said second means are integral therewith.

12. The closure claimed in claim 11 wherein said closure includes a top panel and a threaded skirt depending therefrom, said retaining-rupturing member extending downwardly from said top panel, said second means being situated upwardly of such skirt threads and downwardly of said retaining-rupturing member.

* * * * *